US008919674B2

(12) United States Patent
Watanabe et al.

(10) Patent No.: US 8,919,674 B2
(45) Date of Patent: Dec. 30, 2014

(54) FUEL INJECTION VALVE

(75) Inventors: Kyosuke Watanabe, Chiyoda-ku (JP); Naoya Hashii, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 759 days.

(21) Appl. No.: 13/049,605

(22) Filed: Mar. 16, 2011

(65) Prior Publication Data

US 2012/0104121 A1 May 3, 2012

(30) Foreign Application Priority Data

Nov. 1, 2010 (JP) ..... 2010-245215

(51) Int. Cl.
*F02M 61/00* (2006.01)
*F02M 61/18* (2006.01)
*F02M 51/06* (2006.01)

(52) U.S. Cl.
CPC ..... *F02M 61/1806* (2013.01); *F02M 61/186* (2013.01); *F02M 61/1846* (2013.01); *F02M 51/0667* (2013.01)
USPC ..... 239/533.12; 239/533.11; 239/585.1; 239/585.5; 239/585.3; 239/585.2; 239/596; 239/552; 239/585.4

(58) Field of Classification Search
CPC ..... F02M 61/1806; F02M 61/1846; F02M 5/06671; F02M 61/186
USPC ..... 239/533.12, 585.1–585.5, 596–599, 239/533.14, 552
See application file for complete search history.

(56) References Cited

U.S. PATENT DOCUMENTS

| | | | | |
|---|---|---|---|---|
| 5,762,272 | A * | 6/1998 | Tani et al. | 239/543 |
| 5,860,600 | A * | 1/1999 | Schindler et al. | 239/463 |
| 6,854,670 | B2 * | 2/2005 | Sumisha et al. | 239/543 |
| 2006/0086830 | A1 * | 4/2006 | Omura et al. | 239/533.12 |
| 2009/0206181 | A1 * | 8/2009 | Arndt et al. | 239/533.12 |
| 2012/0325938 | A1 * | 12/2012 | Sakata et al. | 239/585.1 |

FOREIGN PATENT DOCUMENTS

| | | | |
|---|---|---|---|
| JP | 08-200187 | A | 8/1996 |
| JP | 2001-317431 | A | 11/2001 |
| JP | 2006-002720 | A | 1/2006 |

* cited by examiner

*Primary Examiner* — Jason Boeckmann
*Assistant Examiner* — Joel Zhou
(74) *Attorney, Agent, or Firm* — Sughrue Mion, PLLC

(57) ABSTRACT

A fuel injection valve that promotes formation of thin membranes of fuel within injection holes and promotes atomization of spray is obtained. Holes provided in an injection hole plate 11 are combined injection holes 16 formed by partially overlapping two or more single injection holes 15*a*, 15*b*, 15*c* from an upstream side to a downstream side of the injection hole plate 11, each of the single injection holes is a circular hole, the single injection hole has an injection hole angle α defined by a tilt angle of a center axis line connecting an entrance part center and an exit part center relative to a plate thickness direction of the injection hole plate 11, areas of exit parts 16*b* are larger than areas of entrance parts 16*a* in the combined injection holes 16, and the combined injection holes 16 are formed by press working.

14 Claims, 10 Drawing Sheets

Seen from b

State of Fuel Within Injection Holes

Seen from c

Seen from d

Seen from f

State of Fuel Within Injection Holes

Entrance Part of F

Exit Part of F

Entrance Part of G

Exit Part of G

Seen from j

FUEL INJECTION VALVE

BACKGROUND OF THE INVENTION

1. Field of the Invention

The present invention relates to a fuel injection valve mainly used for a fuel supply system of an internal-combustion engine, and specifically to an injection hole plate provided at the downstream side of a valve seat.

2. Description of the Related Art

Recently, with tighter exhaust emission regulation for vehicles and the like, improvements in the degree of freedom of the injection direction and atomization of the fuel spray injected from the fuel injection valve have been required, and particularly, various studies have already been made on the atomization of the fuel spray.

In a fuel injection valve in related art, a fuel injection valve in which a thin injection hole plate with plural injection holes formed therein is provided at the downstream side of a valve member and a valve seat for injecting fuel from the respective injection holes is known. In the fuel injection valve, generally, the injection hole has an equal diameter from its entrance to exit, and, when fuel flows into the injection hole having the equal diameter, the fuel does not spread along the injection hole inner surface but is injected as a liquid column. The fuel as the liquid column is hard to be atomized and may deteriorate combustion in the internal-combustion engine.

In this regard, for example, as shown in Patent Document 1, in order to obtain a liquid membrane sufficiently spread within the injection hole, it is conceivable that the injection hole is tapered. By forming a conical shape spreading at the exit side of the injection hole, it may be expected that the spray spreads along the inner wall surface of the injection hole, and the fuel turns into a thin membrane and is injected.

Further, for example, as shown in Patent Document 2, the fuel entrance is formed in an elliptical shape or plural circles and the fuel is injected from a belt-like exit that smoothly communicates with the entrance, and thus, the spray in the uniform liquid membrane may be injected from the exit and atomization of the fuel may be promoted.

Furthermore, for example, as shown in Patent Document 3, the fuel spray may be atomized by forming an oval injection hole with a major axis and a minor axis to have an injection hole shape with a straight elongated shape and arc shapes on both ends, and making the minor axis shorter. Further, as a modified example of the oval injection hole, three circular injection holes may be aligned on a straight line to form one injection hole.

[Patent Document 1] JP-A-2001-317431 (paragraph 0019, FIG. 4)

[Patent Document 2] JP-A-2006-2720 (paragraph 0061, FIGS. 9 and 11)

[Patent Document 3] JP-A-8-200187 (paragraph 0021, FIGS. 1 and 5)

However, in the case where the tapered injection holes as shown in Patent Document 1 are formed in the injection hole plate, the areas of injection hole entrances may easily vary in respect of working, and there is a problem of variations in flow rate and spray, and further, very complex steps are necessary in respect of manufacture and dimensional management, and there are problems that deterioration of productivity of the fuel injection valve and increase in cost may be caused.

In addition, the injection holes shown in Patent Document 2 and Patent Document 3 have a structure of injecting spray in a shape along a channel shape while filling the injection hole with fuel. Accordingly, there are problems that air bubbles produced in the fuel due to decompression boiling at the downstream side of the injection hole at a high temperature under negative pressure are clogged at the injection hole exit, and flow characteristics (static flow, dynamic flow) with changes in temperature, atmosphere pressure, etc. largely change.

SUMMARY OF THE INVENTION

A fuel injection valve according to the invention is to solve the above described problems for easier manufacturing, formation of thin membranes of fuel in injection holes, promotion of atomization of spray, and smaller changes in flow characteristics.

A fuel injection valve according to the invention has a valving element that opens and closes a valve seat, and, when opening the valve seat with the valving element, allows fuel to pass through between the valving element and a valve seat surface and to be injected from plural holes provided in an injection hole plate attached at a downstream side of the valve seat, wherein the holes provided in the injection hole plate are combined injection holes formed by partially overlapping two or more single injection holes from an upstream side to a downstream side of the injection hole plate, each of the single injection holes is a circular hole having the same diameter in an entrance part at the upstream side and an exit part at the downstream side of the injection hole plate, at least one of the single injection holes has an injection hole angle $\alpha$ defined by a tilt angle of a center axis line connecting an entrance part center and an exit part center relative to a plate thickness direction of the injection hole plate, intersection angles $\beta$ are provided so that, if center axis lines of the respective single injection holes forming the combined injection holes are projected on a plane orthogonal to a valve seat axis, the center axis lines of the respective single injection holes may intersect, and thereby, areas of exit parts are larger than areas of entrance parts in the combined injection holes, and the combined injection holes are formed by press working.

According to the fuel injection valve of the invention, since the combined injection holes are formed by partially overlapping the two or more single injection holes from the upstream side to the downstream side of the injection hole plate, manufacturing is easy, and, since the area of the inner circumferential surface of the combined injection hole becomes larger toward the exit side, formation of thin membranes of fuel may be promoted within the combined injection holes and atomization of spray may be promoted. Further, depending on the shapes of the combined injection holes to be formed, various spray forms may be realized without the expense of atomization. Furthermore, if air bubbles are produced in the fuel due to decompression boiling of part of the fuel, when the fuel enters from the entrances within the combined injection holes, the fuel is pressed against the wall surfaces within the combined injection holes, turns into thin membranes. In addition, compared to the injection hole having the equal diameter from the injection hole entrance to the exit, the area of the inner circumferential surface of the combined injection hole becomes larger toward the exit side, and thus, air bubbles may be easily ejected from the combined injection hole and the changes in characteristics (static flow, dynamic flow) with changes in atmosphere may be made smaller.

The foregoing and other object, features, aspects and advantages of the present invention will become more apparent from the following detailed description of the present invention when taken in conjunction with the accompanying drawings.

DETAILED DESCRIPTION OF THE INVENTION

Embodiment 1

Figure 1:
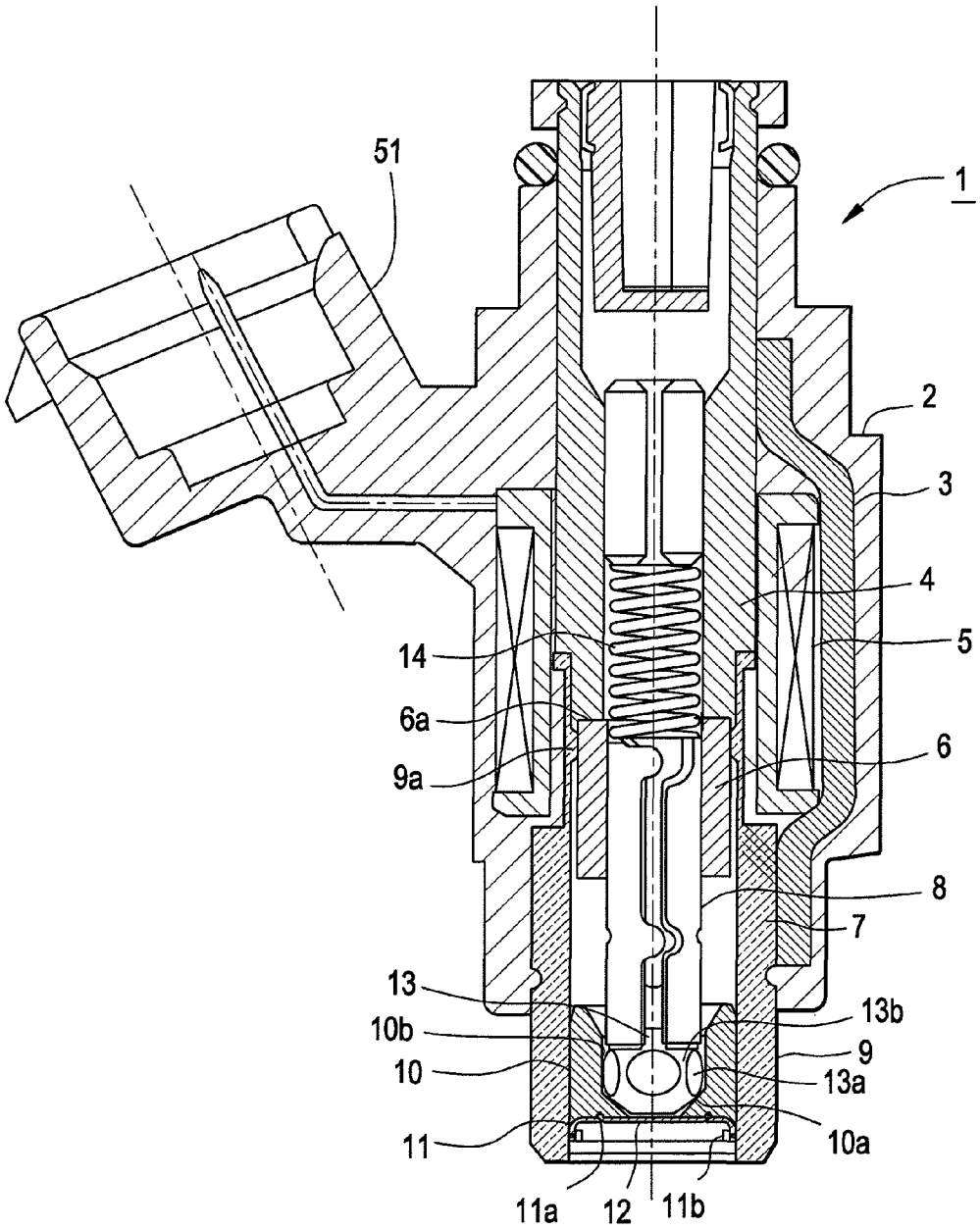
FIG. 1 is a sectional view of a fuel injection valve in embodiment 1 of the invention.

FIG. 1 is a sectional view of a fuel injection valve in embodiment 1 of the invention. In the drawing, a fuel injection valve 1 has a solenoid device 2, a housing 3 as a yoke part of a magnetic circuit, a core 4 as a fixed iron core part of the magnetic circuit, a coil 5, an armature 6 as a movable iron core part of the magnetic circuit, and a valve device 7. The valve device 7 includes a valving element 8, a valve main body 9, and a valve seat 10. The valve main body 9 is press-fitted in the outer diameter part of the core 4 and welded. The armature 6 is press-fitted into the valving element 8 and welded. In the valve seat 10, an injection hole plate 11 coupled to the downstream side of the valve seat in a welding part 11*a* is inserted into the valve main body 9, and coupled in a welding part 11*b*. In the injection hole plate 11, plural holes 12 penetrating in the plate thickness direction are provided.

Next, an operation will be explained. When an operation signal is sent from a controller of an engine to a drive circuit (not shown) of the fuel injection valve 1, a current is conducted in the coil 5 of the fuel injection valve 1, magnetic flux is generated in the magnetic circuit including the armature 6, the core 4, the housing 3, and the valve main body 9 is attracted to the core 4, and an upper surface 6*a* of the armature 6 is brought into contact with the lower surface of the core 4. When the valving element 8 integrated with the armature 6 moves away from a valve seat surface 10*a* to form a clearance, the fuel passes from plural grooves 13*a* provided at a leading end part (ball) 13 of the valving element 8 through the clearance between the valve seat surface 10*a* and the valving element 8, and is injected from the plural holes 12 to an engine intake pipe.

When a stop signal of the operation is sent from the controller of the engine to the drive circuit of the fuel injection valve 1, the conduction of the current from a connector 51 to the coil 5 is stopped, the magnetic flux in the magnetic circuit is reduced, the clearance between the valving element 8 and the valve seat surface 10*a* is closed by the elastic force of a compression spring 14 that pushes the valving element 8 in the valve closing direction, and the fuel injection ends. At opening and closing operation of the valving element 8, the valving element 8 slides along a guide part 9*a* projecting inward in the radial direction of the valve main body 9, and a guide part 13*b* of the ball 13 of the valving element 8 slides along a valve seat sliding part 10*b*. The guide part 13*b* is means for regulating non-coaxiality (waggle) of the valving element 8 in the radial direction relative to the valve seat sliding part 10*b*. Therefore, it is preferable to set the clearance as small as possible, and the clearance is set to 10 μm or less (the clearance at one side is 5 μm or less) to make the wear resistance of the valving element 8 within the acceptable limit.

Figure 2A:
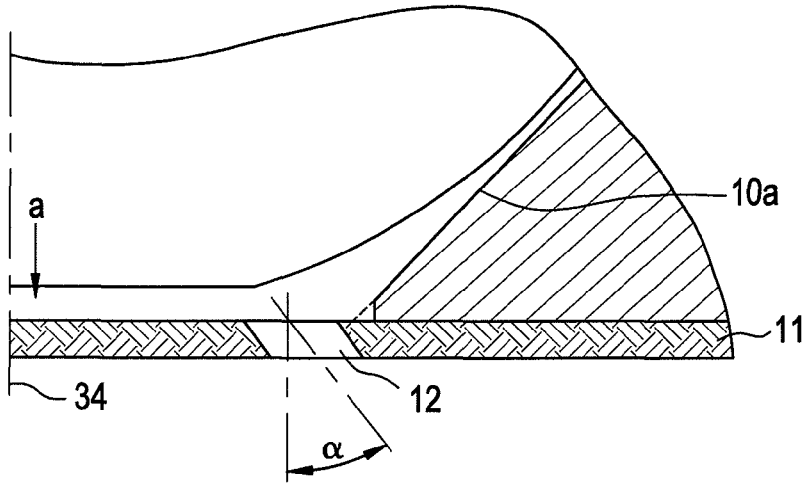
FIGS. 2A to 2C show an injection hole plate unit in the leading end part of the fuel injection valve in embodiment 1.
Figure 2B:
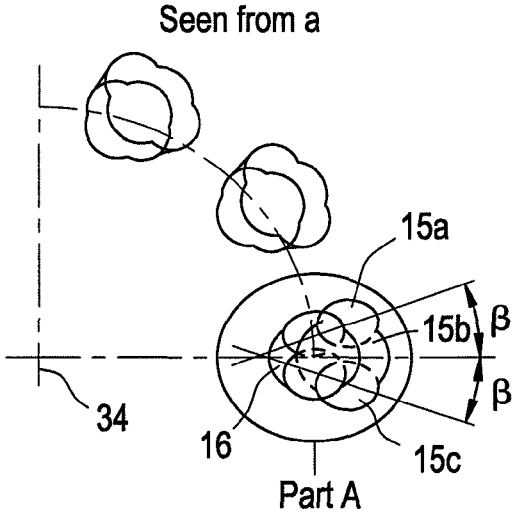
Figure 2C:
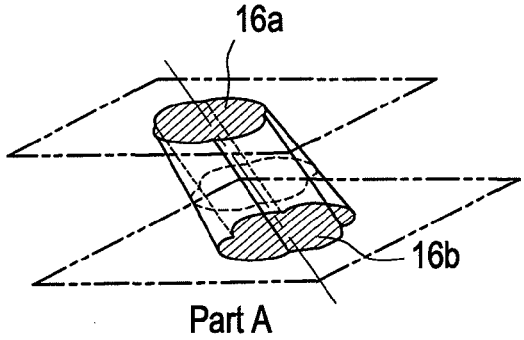

FIGS. 2A to 2C show an injection hole plate unit in the leading end part of the fuel injection valve in embodiment 1, and FIG. 2A is "a" sectional view, FIG. 2B is a plan explanatory diagram seen from a in FIG. 2A, and FIG. 2C is a stereoscopic explanatory diagram of part A in FIG. 2B. The plural holes 12 in the injection hole plate 11 of the fuel injection valve 1 of embodiment 1 are respectively formed in the following manner. As shown in FIGS. 2B and 2C, three single injection holes 15*a*, 15*b*, 15*c* are continuously and partially overlapped from the upstream side (upstream surface) to the downstream side (downstream surface) of the injection hole plate 11 to form a combined injection hole 16. The respective single injection holes 15*a*, 15*b*, 15*c* are circular holes having the same diameters (cylindrical holes) from the entrance parts at the upstream side to the exit parts at the downstream side of the injection hole plate 11. Of the three single injection holes 15*a*, 15*b*, 15*c*, the injection hole diameter of the middle single injection hole 15*b* is made larger than those of the other two single injection holes 15*a*, 15*c*, and the single injection holes 15*a*, 15*b*, 15*c* have injection hole angles α defined by tilt angles of center axis lines connecting the respective entrance part centers and the exit part centers relative to the plate thickness direction of the injection hole plate. The injection hole diameters of the single injection hole 15*a* and the single injection hole 15*c* are the same.

In order that the area of the exit part may be larger than the area of the entrance part in the combined injection hole 16, predetermined angles β are provided between the adjacent single injection holes so that, if the center axis lines in the single injection holes 15*a*, 15*b*, 15*c* are projected on a plane orthogonal to a valve seat axis 34, the center axis lines of the respective single injection holes 15*a*, 15*b*, 15*c* may intersect. It is not necessary that the angle between the single injection holes 15*a*, 15*b* and the angle between the single injection holes 15*b*, 15*c* are the same, or it is not necessary that the center axis lines of the respective single injection holes 15*a*, 15*b*, 15*c* intersect at one point.

The mainstream of the fuel flow from the valve seat surface 10*a* flows from the outside to the inside in the radial direction of the valve seat axis 34 of the fuel injection valve into the entrance part 16*a* of the combined injection hole 16, and a liquid membrane is formed by the separation of the flow in the entrance part 16*a* of the combined injection hole 16, the fuel is pressed toward the valve seat axis 34 within the combined injection hole 16, the flow within the combined injection hole 16 becomes a flow along the curvature of the combined injection hole 16, and injected from the exit part 16*b* of the combined injection hole 16. Note that, in embodiment 1, all of the holes forming the combined injection hole 16 have the injection angle α, however, it is necessary at least one of the plural single injection holes forming the combined injection hole 16 has the injection angle α.

The combined injection hole 16 is formed by respectively press working the single injection holes 15*a*, 15*b*, 15*c* in the injection hole plate 11 and overlapping the circular holes of the single injection holes 15*a*, 15*b*, 15*c*. Alternatively, the shape of the combined injection hole 16 may be press-worked. In either case, manufacturing is easy because the combined injection hole 16 is formed by combining the circular holes.

Since the fuel injection valve in embodiment 1 has the above described configuration and the area of the inner circumferential surface of the combined injection hole becomes larger toward the exit side compared to the injection hole having the equal diameter from the injection hole entrance to the exit, formation of the thin membrane of the fuel within the combined injection hole is promoted toward the exit part 16*b*, and the spray may be atomized. Further, as described above, since the combined injection hole is not filled with the fuel and the fuel turns into the thin liquid membrane while pressed against inside of the combined injection hole and is injected from the exit part 16*b* of the combined injection hole 16, the air bubbles produced within the combined injection hole 16 may be easily ejected and the changes in flow characteristics (static flow, dynamic flow) with changes in atmosphere may be made smaller.

Embodiment 2

Figure 3A:
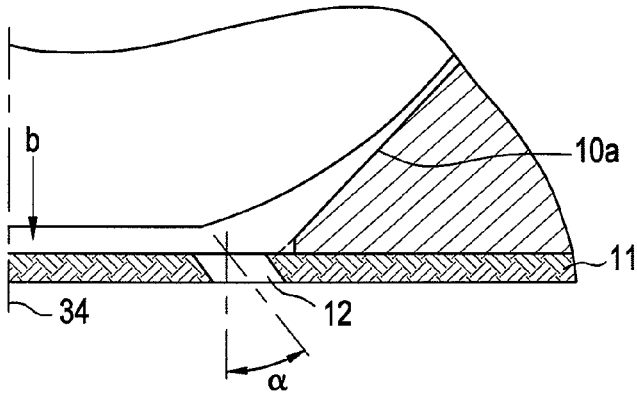
FIGS. 3A to 3D show an injection hole plate unit in the leading end part of a fuel injection valve in embodiment 2.
Figure 3B:
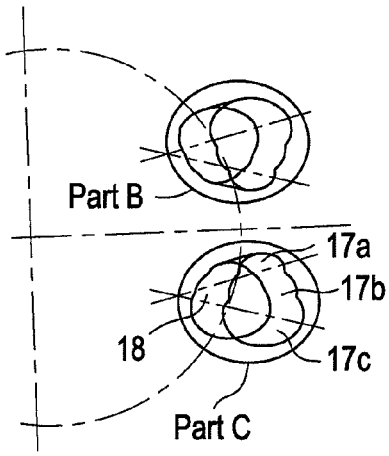
Figure 3C:
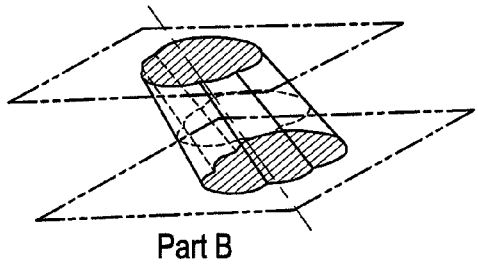
Figure 3D:
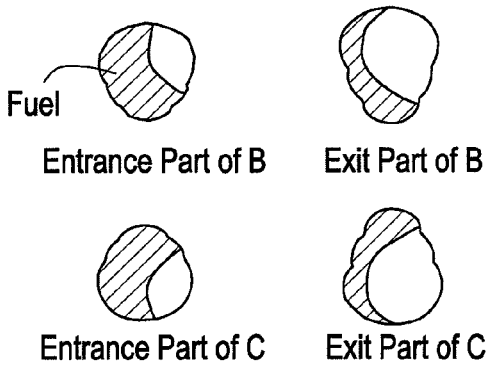

FIGS. 3A to 3D show an injection hole plate unit in the leading end part of a fuel injection valve in embodiment 2, FIG. 3A is a sectional view, FIG. 3B is a plan explanatory diagram seen from "b" in FIG. 3A, FIG. 3C is a stereoscopic explanatory diagram of part B in FIG. 3B, and FIG. 3D is an explanatory diagram showing a state of fuel within injection holes in part B, part C in FIG. 3B. The plural holes 12 in the injection hole plate 11 of the fuel injection valve 1 of embodiment 2 are formed in the following manner. Three single injection holes 17*a*, 17*b*, 17*c* are continuously and partially overlapped from the upstream side (upstream surface) to the downstream side (downstream surface) of the injection hole plate 11 to form a combined injection hole 18.

The single injection holes 17*a*, 17*b*, 17*c* are circular holes having the same diameters (cylindrical holes) from the entrance parts at the upstream side to the exit parts at the downstream side of the injection hole plate 11, and the injection hole diameters of the three single injection holes 17*a*, 17*b*, 17*c* are different from one another. In the case of part B in FIG. 3B, the injection hole diameters of the single injection holes sequentially become smaller from upside toward downside of the paper, and, in part C, the injection hole diameters of the single injection holes 17*a*, 17*b*, 17*c* sequentially become larger from upside toward downside of the paper. The single injection holes 17*a*, 17*b*, 17*c* have injection hole angles $\alpha$ defined by tilt angles of center axis lines connecting the respective entrance part centers and the exit part centers relative to the plate thickness direction of the injection hole plate. However, the injection hole angles $\alpha$ of the single injection holes 17*a*, 17*b*, 17*c* may be different. Note that the rest of the configuration is the same as that in embodiment 1, and the area of the exit part is larger than the area of the entrance part in the combined injection hole 18, the combined injection hole 18 is formed by combining the circular holes, and thereby, manufacturing is easy.

Since the different combined injection holes 18 (part B, part C as shown in FIG. 3B, the spreads of the fuel within the combined injection holes 18 are not uniform (see FIG. 3D), and the fuel is injected with the difference between liquid membrane thicknesses of the fuel within the combined injection holes. A plurality of the above described different combined injection holes 18 are provided within the injection hole plate 11 and one collective spray is formed by a group of the combined injection holes, and thereby, wide variations may be realized in concentration distribution and its form within the one collective spray.

Generally, the angle of the spray formed by the edge line of the collective spray (hereinafter, referred to as "spray angle") and the particle size of the collective spray have a trade-off relation, and, larger the spray angle, the smaller the particle size. In the fuel injection type internal-combustion engine, by supplying the atomized fuel, ignition is promptly completed, the combustion efficiency becomes higher, the emission concentration of the exhaust gas, particularly, carbon hydride is reduced, and thus, atomization of the fuel is necessary for raising the combustion efficiency.

In the fuel injection valve in related art, the spray having a nearly uniform particle size within a collective spray is injected to the intake valve and, in this regard, a certain fixed amount of the outside part with respect to the center axis of the spray adheres to the inner wall of the intake port. If the spray angle is made larger in order to atomize the collective spray having the nearly uniform particle size, the adhesion to the inner wall of the intake port increases, the fuel moving along the inner wall, turning into a liquid membrane, and flowing into an air cylinder with a delay increases, and thereby, the combustion efficiency becomes lower, and, as a result, the concentration of carbon hydride HC in the exhaust gas becomes higher and the engine controllability becomes deteriorated.

Figure 4A:
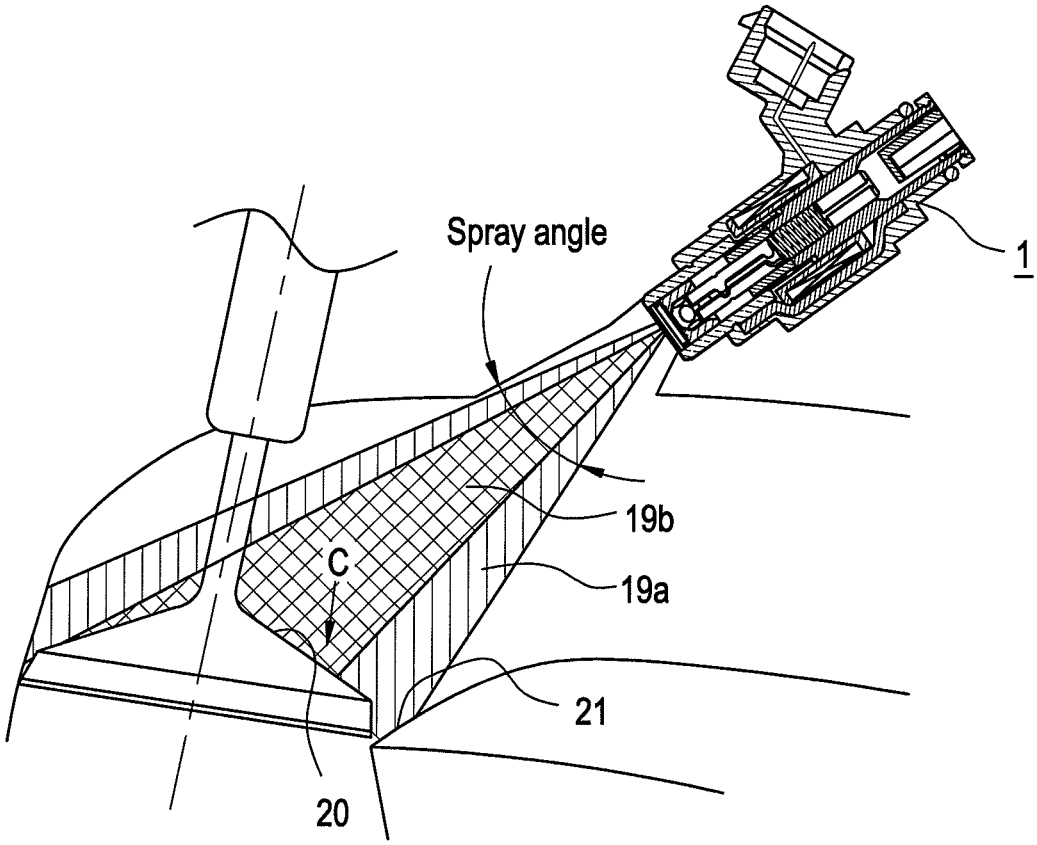
FIGS. 4A and 4B are explanatory diagrams showing a state of fuel injection to an intake port and an intake valve in the fuel injection valve in embodiment 2.
Figure 4B:
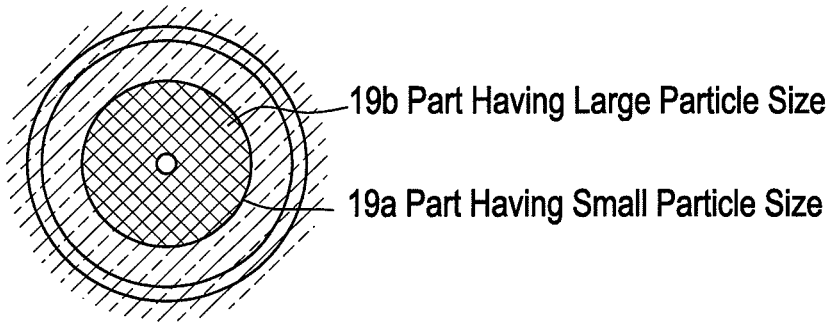

FIGS. 4A and 4B are explanatory diagrams showing a state of fuel injection to an intake port and an intake valve in the fuel injection valve in embodiment 2, and FIG. 4A is a sectional explanatory diagram of the intake port and the intake valve part, FIG. 4B is the top explanatory diagram seen from "c" in FIG. 4A. In embodiment 2, compared to the related art example, the fuel within the combined injection holes 18 is non-uniformly formed in liquid membranes, a difference is provided in the particle size distribution within the collective spray formed by the injections from the group of combined injection holes, and, as shown in FIGS. 4A and 4B, a part 19*a* having the smaller particle size is formed at the outside of the collective spray and a part 19*b* having the larger particle size at the expense of atomization inside for atomization of the outside is formed, and the part with the larger particle size 19*b* is brought into contact with an intake valve center part 20 at a high temperature to be promptly gasified and the adhesion to an intake port inner wall 21 is reduced in the outside spray, and thereby, the combustion efficiency may be raised.

Embodiment 3

Figure 5A:
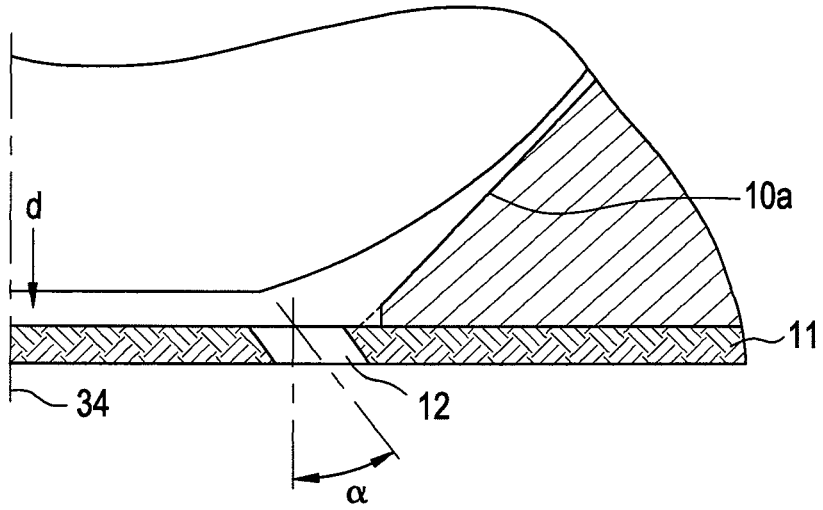
FIGS. 5A to 5C show an injection hole plate unit in the leading end part of a fuel injection valve in embodiment 3.
Figure 5B:
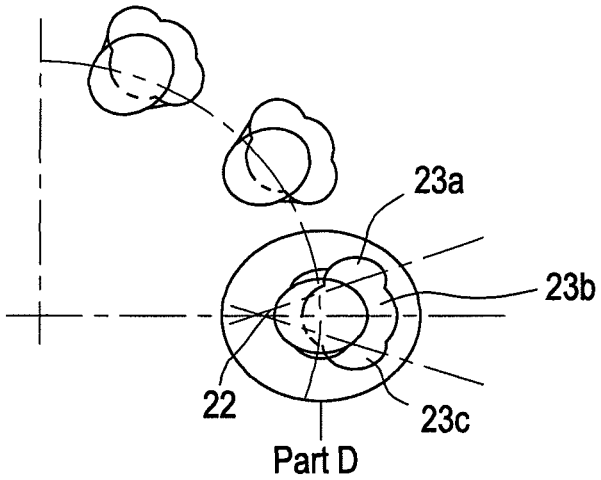
Figure 5C:
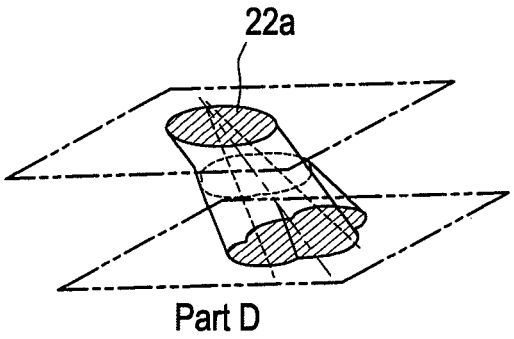

FIGS. 5A to 5C show an injection hole plate unit in the leading end part of a fuel injection valve in embodiment 3, and FIG. 5A is a sectional view, FIG. 5B is a plan explanatory diagram seen from "d" in FIG. 5A, and FIG. 5C is a stereoscopic explanatory diagram of part D in FIG. 5B. The plural holes 12 in the injection hole plate 11 of the fuel injection valve 1 according to embodiment 3 are respectively formed in the following manner. As shown in FIGS. 5B and 5C, three single injection holes 23*a*, 23*b*, 23*c* are continuously and partially overlapped from the upstream side (upstream surface) to the downstream side (downstream surface) of the injection hole plate 11 to form a combined injection hole 22. The respective single injection holes 23*a*, 23*b*, 23*c* are circular holes having the same diameters (cylindrical holes) from the entrance parts at the upstream side to the exit parts at the downstream side of the injection hole plate 11. They are formed so that the area of an entrance part 22*a* in the combined injection hole 22 may be equal to the area of the entrance part of the single injection hole 23*b* having the maximum injection hole diameter of the three single injection holes 23*a*, 23*b*, 23*c* forming the combined injection hole 22. Therefore, the injection hole diameters of the other two single injection holes 23*a*, 23*c* are equal to or less than the injection hole diameter of the single injection hole 23*b*.

The rest of the configuration is the same as that in embodiment 1, and the single injection holes 23*a*, 23*b*, 23*c* have injection hole angles α defined by tilt angles of center axis lines connecting the respective entrance part centers and the exit part centers relative to the plate thickness direction of the injection hole plate, and the area of the exit part is larger than the area of the entrance part in the combined injection hole 22, the combined injection hole 22 is formed by combining the circular holes, and thereby, manufacturing is easy. Note that, in the single injection holes 23*a*, 23*b*, 23*c*, the injection hole angles α may be different from one another.

According to embodiment 3, as is the case of embodiment 1, the atomization of the fuel spray may be promoted. Further, the area of the entrance part 22*a* in the combined injection hole 22 is made equal to the area of the entrance part of the single injection hole 23*b* having the maximum injection hole diameter of the three single injection holes 23*a*, 23*b*, 23*c*, and thus, variations in flow rate due to variations in work position of the other single injection holes 23*a*, 23*c* may be suppressed.

Embodiment 4

Figure 6A:
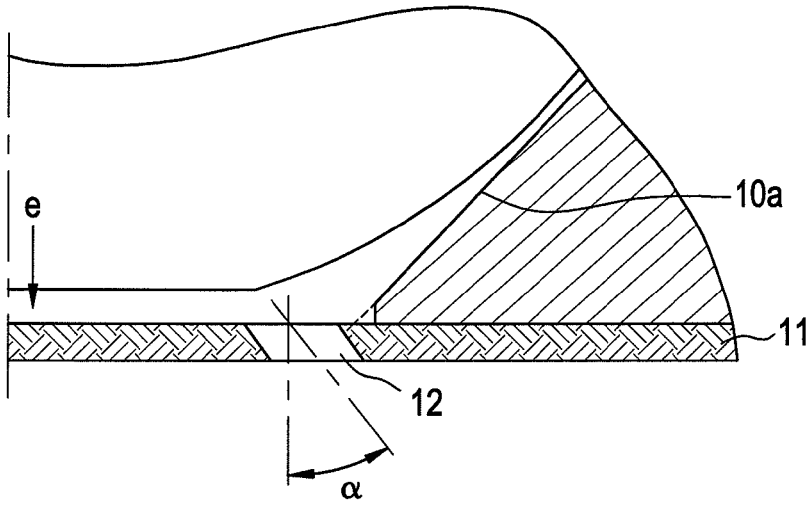
FIGS. 6A to 6C show an injection hole plate unit in the leading end part of a fuel injection valve in embodiment 4.
Figure 6B:
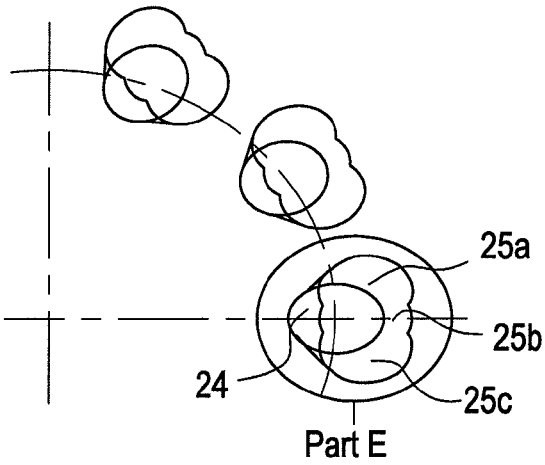
Figure 6C:
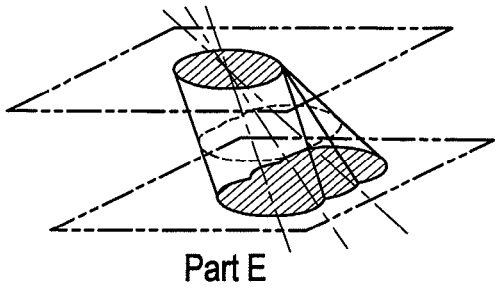

FIGS. 6A to 6C show an injection hole plate unit in the leading end part of a fuel injection valve in embodiment 4, and FIG. 6A is a sectional view, FIG. 6B is a plan explanatory diagram seen from "e" in FIG. 6A, and FIG. 6C is a stereoscopic explanatory diagram of part E in FIG. 6B. The plural holes 12 in the injection hole plate 11 of the fuel injection valve 1 according to embodiment 4 are respectively formed in the following manner. As shown in FIGS. 6B and 6C, three single injection holes 25*a*, 25*b*, 25*c* are continuously and partially overlapped from the upstream side (upstream surface) to the downstream side (downstream surface) of the injection hole plate 11 to form a combined injection hole 24. The respective single injection holes 25*a*, 25*b*, 25*c* are circular holes having the same diameters (cylindrical holes) from the entrance parts at the upstream side to the exit parts at the downstream side of the injection hole plate 11. The diameters of all of the single injection holes 25*a*, 25*b*, 25*c* are equal and the injection hole angles α explained in embodiment 1 are equal for the three single injection holes 25*a*, 25*b*, 25*c*, however, they may be different from one another.

The rest of the configuration is the same as that in embodiment 1, and the area of the exit part is larger than the area of the entrance part in the combined injection hole 24, the combined injection hole 24 is formed by combining the circular holes, and thereby, manufacturing is easy. Further, the locations of the entrance parts of the single injection holes 25*a*, 25*b*, 25*c* are overlapped and the area of the entrance part in the combined injection hole 24 is equal to the area of the entrance part of the single injection hole.

By forming the combined injection hole 24 as shown in FIGS. 6A to 6C, the atomization of the fuel spray may be promoted as is the case of embodiment 1. Further, in the case where the single injection holes 25*a*, 25*b*, 25*c* are manufactured by press working, when the injection holes are equal and further the injection hole angles α are equal, it is not necessary to prepare many types of punches for injection hole formation at manufacturing, and they may be manufactured at the lower cost than in the other embodiments.

Embodiment 5

Figure 7A:
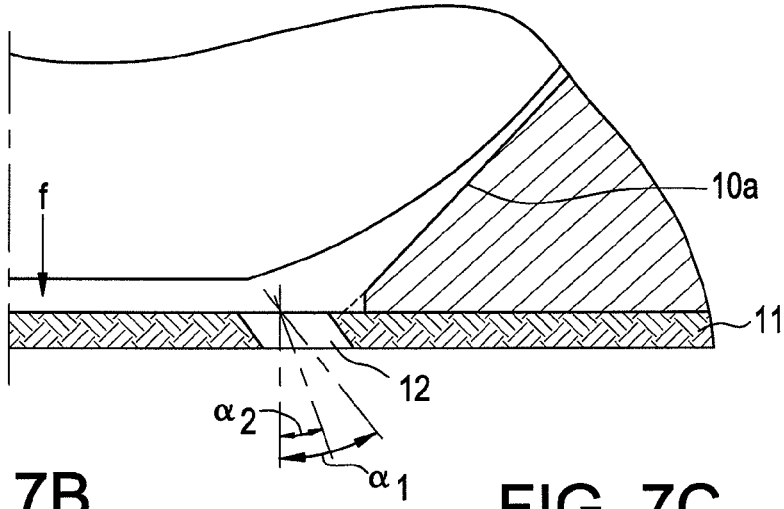
FIGS. 7A to 7D show an injection hole plate unit in the leading end part of a fuel injection valve in embodiment 5.
Figure 7B:
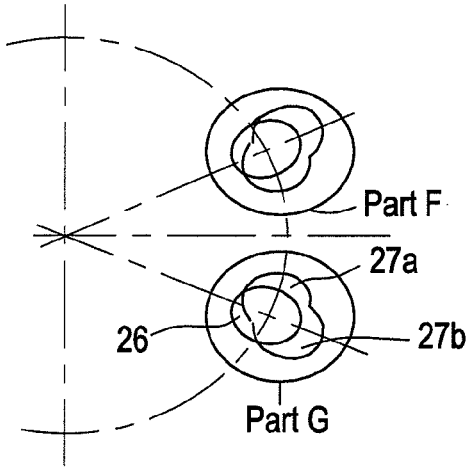
Figure 7C:
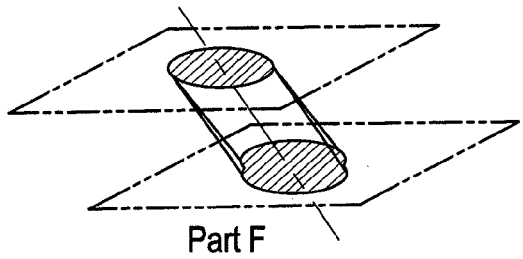
Figure 7D:
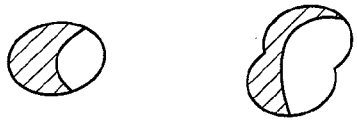
Figure 7D:
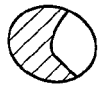
Figure 7D:
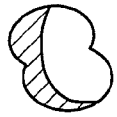

FIGS. 7A to 7D show an injection hole plate unit in the leading end part of a fuel injection valve in embodiment 5, and FIG. 7A is a sectional view, FIG. 7B is a plan explanatory diagram seen from "f" in FIG. 7A, FIG. 7C is a stereoscopic explanatory diagram of part F in FIG. 7B, and FIG. 7D is an explanatory diagram showing a state of fuel within injection holes in part F, part G in FIG. 7B. The plural holes 12 in the injection hole plate 11 of the fuel injection valve 1 of embodiment 5 are formed in the following manner. Two single injection holes 27*a*, 27*b* are continuously and partially overlapped from the upstream side (upstream surface) to the downstream side (downstream surface) of the injection hole plate 11 to form a combined injection hole 26.

The respective single injection holes 27*a*, 27*b* are circular holes having the same diameters (cylindrical holes) from the entrance parts at the upstream side to the exit parts at the downstream side of the injection hole plate 11, and the injection hole diameters of the single injection holes 27*a*, 27*b* are equal. The single injection holes 27*a*, 27*b* respectively have injection hole angles α1, α2 defined by tilt angles of center axis lines connecting the entrance part centers and the exit part centers relative to the plate thickness direction of the injection hole plate, and the injection hole angle α1 and the injection hole angle α2 are different from each other. Note that the rest of the configuration is the same as that in embodiment 1, and the area of the exit part is larger than the area of the entrance part in the combined injection hole 26, the combined injection hole 26 is formed by combining the circular holes, and thereby, manufacturing is easy. Further, the locations of the entrance parts of the single injection holes 27*a*, 27*b* are overlapped and the area of the entrance part in the combined injection hole 26 is equal to the area of the entrance part of the single injection hole. The injection hole diameters of the single injection holes 27*a*, 27*b* may not necessarily be equal.

By forming the combined injection hole 26 as shown in FIGS. 7A to 7D, the atomization of the fuel spray may be promoted as is the case of embodiment 1. Further, in the case where the single injection holes 27*a*, 27*b* are manufactured by press working, when the injection holes are equal, it is not necessary to prepare many types of punches for injection hole formation at manufacturing, and they may be manufactured at the lower cost than in the other embodiments in which the injection hole diameters are not equal. By forming the combined injection hole 26 as shown in FIGS. 7A to 7D, as is the case of embodiment 2, the spread of the liquid membrane within the combined injection hole becomes non-uniform, and the same effect as that of embodiment 2 may be obtained.

Embodiment 6

Figure 8A:
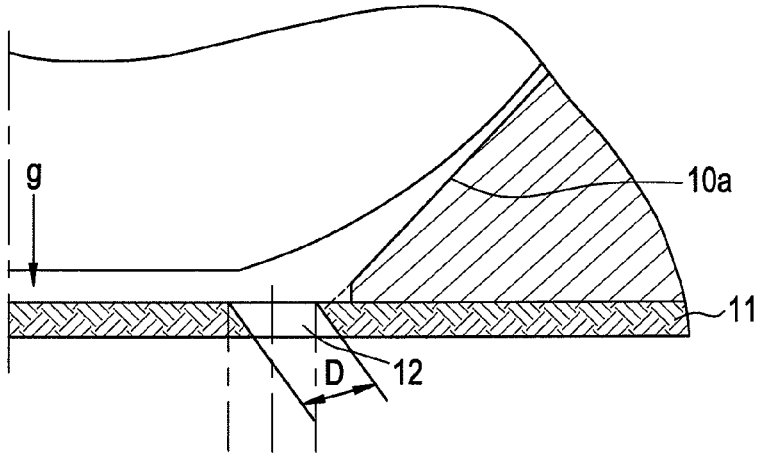
FIGS. 8A to 8D show an injection hole plate unit in the leading end part of a fuel injection valve in embodiment 6.
Figure 8B:
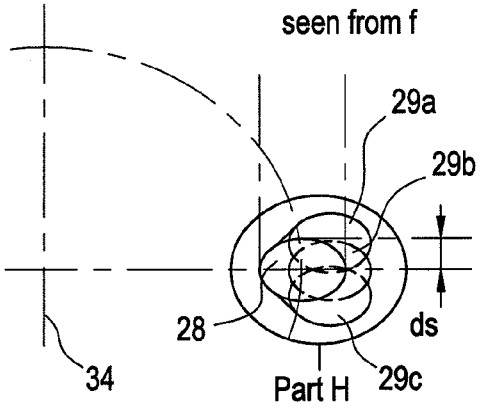
Figure 8C:
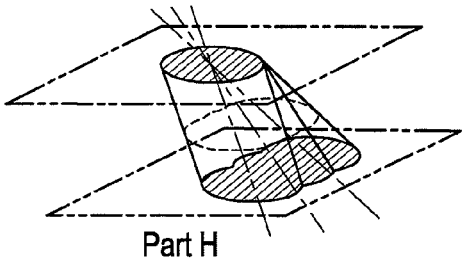
Figure 8D:
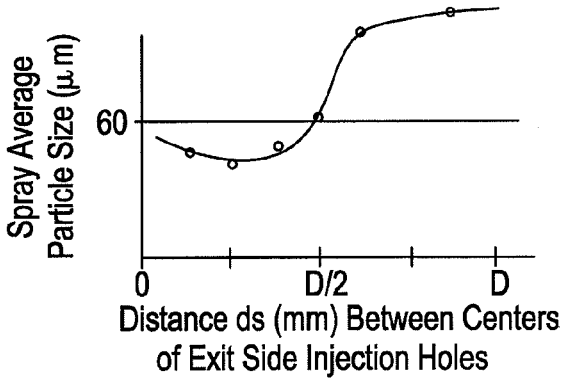

FIGS. 8A to 8D show an injection hole plate unit in the leading end part of a fuel injection valve in embodiment 6, and FIG. 8A is a sectional view, FIG. 8B is a plan explanatory diagram seen from "g" in FIG. 8A, FIG. 8C is a stereoscopic explanatory diagram of part H in FIG. 8B, and FIG. 8D is a characteristic graph of the spray average particle size (μm) and the distance ds (mm) between injection hole centers in the injection hole exit parts. Single injection holes 29*a*, 29*b*, 29*c* are continuously and partially overlapped from the upstream side (upstream surface) to the downstream side (downstream surface) of the injection hole plate 11 to form a combined injection hole 28.

The respective single injection holes 29*a*, 29*b*, 29*c* are circular holes having the same diameters (cylindrical holes) from the entrance parts at the upstream side to the exit parts at the downstream side of the injection hole plate 11, and all of the injection hole diameters D of the single injection holes 29*a*, 29*b*, 29*c* are the same. The single injection holes 29*a*, 29*b*, 29*c* have the injection hole angles α defined in the above description, and all of the injection hole angles α may be the same or different from one another. Note that the rest of the configuration is the same as that in embodiment 1, and the area of the exit part is larger than the area of the entrance part in the combined injection hole 28, the combined injection hole 28 is formed by combining the circular holes, and thereby, manufacturing is easy. Further, the locations of the entrance parts of the single injection holes 29*a*, 29*b*, 29*c* are overlapped and the area of the entrance part in the combined injection hole 28 is equal to the area of the entrance part of the single injection hole.

According to experiments, given that the distance between the centers in the exit parts of the adjacent single injection holes 29*a*, 29*b* is ds (mm), as shown in FIG. 8D, it is known that, if the relation between the spray average particle size (μm) and ds is $0<ds\leq D/2$, formation of the thin membrane within the combined injection hole 28 is promoted and the desired spray particle size is obtained. Further, it is known that, if $ds>D/2$, the overlapping parts of the respective single injection holes inhibit the spread of the fuel within the combined injection hole, and desired spray particle size is not obtained.

Embodiment 7

Figure 9A:
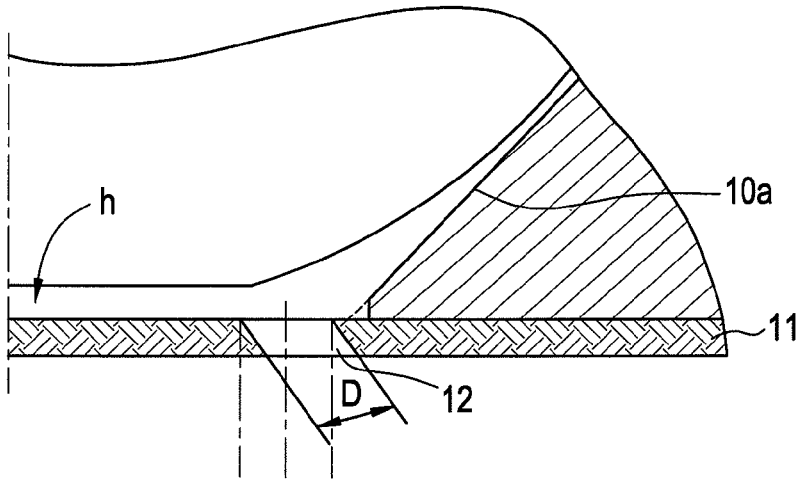
FIGS. 9A to 9D show an injection hole plate unit in the leading end part of a fuel injection valve in embodiment 7.
Figure 9B:
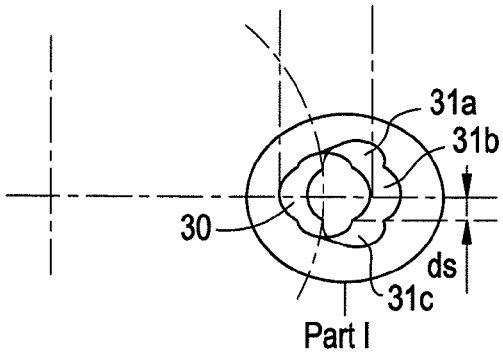
Figure 9C:
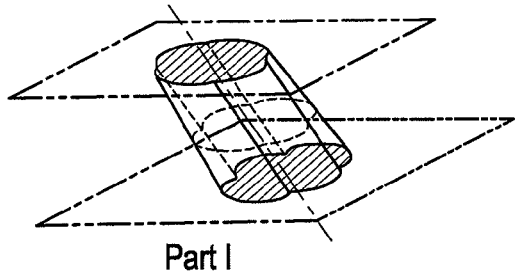
Figure 9D:
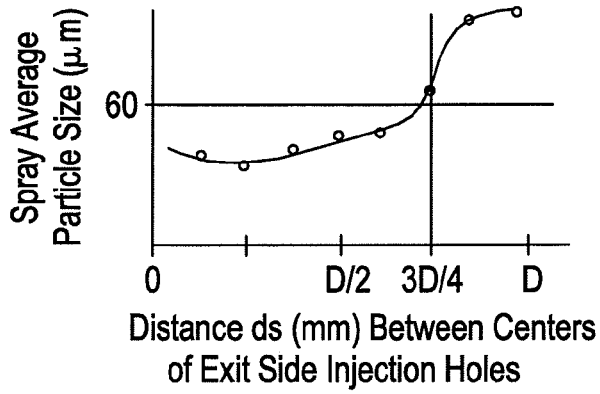

FIGS. 9A to 9D show an injection hole plate unit in the leading end part of a fuel injection valve in embodiment 7, and FIG. 9A is a sectional view, FIG. 9B is a plan explanatory diagram seen from "h" in FIG. 9A, FIG. 9C is a stereoscopic explanatory diagram of part I in FIG. 9B, and FIG. 9D is a characteristic graph of the spray average particle size (μm) and the distance ds (mm) between injection hole centers in the injection hole exit parts. Single injection holes 31*a*, 31*b*, 31*c* are continuously and partially overlapped from the upstream side (upstream surface) to the downstream side (downstream surface) of the injection hole plate 11 to form a combined injection hole 30.

The respective single injection holes 31*a*, 31*b*, 31*c* are circular holes having the equal diameters (cylindrical holes) from the entrance parts at the upstream side to the exit parts at the downstream side of the injection hole plate 11, and the injection hole diameters of the adjacent single injection holes 31*a*, 31*b* and single injection holes 31*b*, 31*c* are different from each other. In the case of embodiment 7, the injection hole diameters of the single injection holes 31*a*, 31*c* are the same, however, they may be different. The single injection holes 31*a*, 31*b*, 31*c* have the injection hole angles α defined in the above description, and all of the injection hole angles α may be the same or different from one another. Note that the rest of the configuration is the same as that in embodiment 1, and the area of the exit part is larger than the area of the entrance part in the combined injection hole 30, the combined injection hole 30 is formed by combining the circular holes, and thereby, manufacturing is easy.

According to experiments, given that the injection hole diameter of 31*b* having the larger injection hole diameter of the adjacent single injection holes 31*b*, 31*c* is D and the distance between the centers in the exit parts of the adjacent single injection holes 31*b*, 31*c* is ds (mm), as shown in FIG. 9D, it is known that, if the relation between the spray average particle size (μm) and ds is $0<ds\leq 3D/4$, formation of the thin membrane within the combined injection hole 30 is promoted and the desired spray particle size is obtained. Further, it is known that, if $ds>3D/4$, the overlapping parts of the respective single injection holes inhibit the spread of the fuel within the combined injection hole, and desired spray particle size is not obtained.

Embodiment 8

Figure 10A:
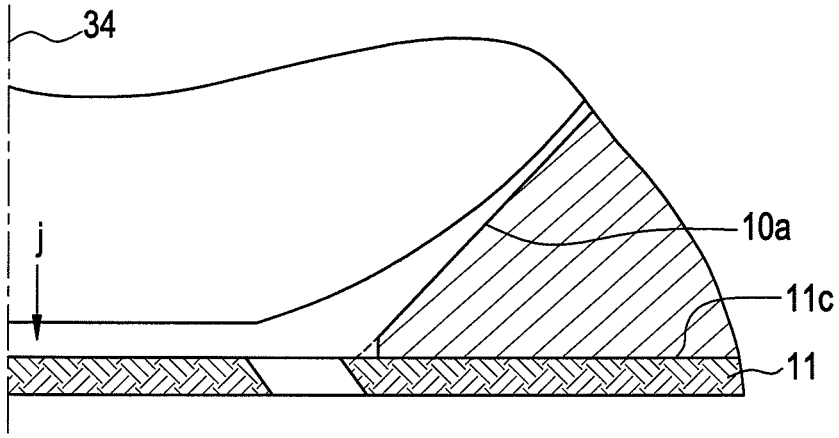
FIGS. 10A to 10C show an injection hole plate unit in the leading end part of a fuel injection valve in embodiment 8.
Figure 10B:
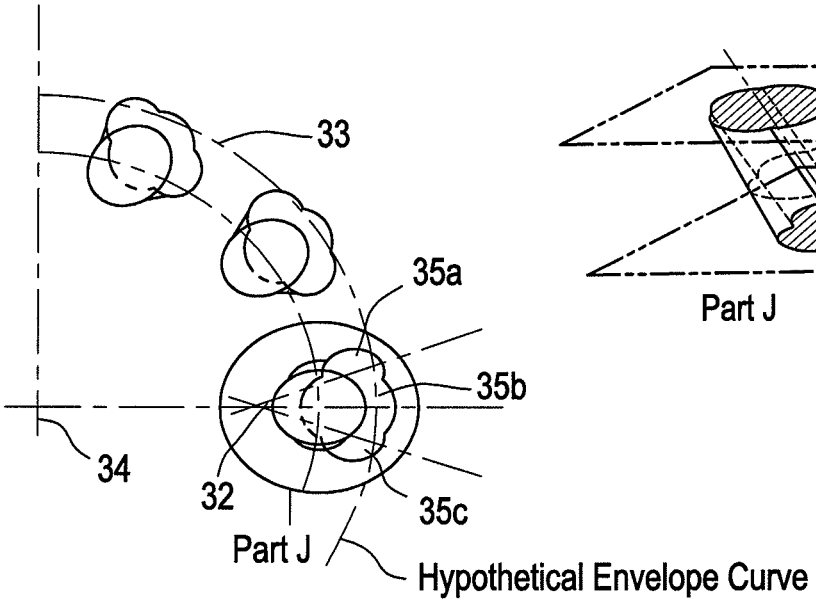
Figure 10C:
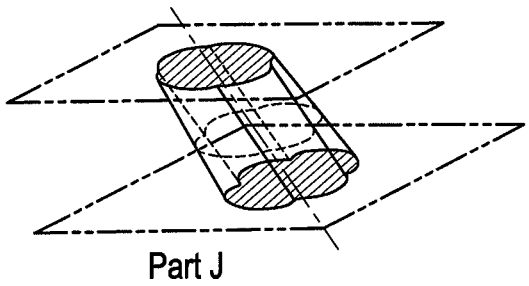

FIGS. 10A to 10C show an injection hole plate unit in the leading end part of a fuel injection valve in embodiment 8, and FIG. 10A is a sectional view, FIG. 10B is a plan explanatory diagram seen from "j" in FIG. 10A, FIG. 10C is a stereoscopic explanatory diagram of part J in FIG. 10B. Single injection holes 35*a*, 35*b*, 35*c* are continuously and partially overlapped from the upstream side (upstream surface) to the downstream side (downstream surface) of the injection hole plate 11 to form a combined injection hole 32.

The respective single injection holes 35*a*, 35*b*, 35*c* are circular holes having the equal diameters (cylindrical holes) from the entrance parts at the upstream side to the exit parts at the downstream side of the injection hole plate 11, and the injection hole diameters of the adjacent single injection holes 35*a*, 35*b*, 35*c* may be different or the same. The single injection holes 35*a*, 35*b*, 35*c* have the injection hole angles α defined in the above description, and all of the injection hole angles α may be the same or different from one another. Note that the rest of the configuration is the same as that in embodiment 1, and the area of the exit part is larger than the area of the entrance part in the combined injection hole 32, the combined injection hole 32 is formed by combining the circular holes, and thereby, manufacturing is easy.

In embodiment 8, the entrance part of the combined injection hole 32 is provided inside a hypothetical envelope curve 33 at which the extension of the valve seat surface 10*a* of the valve seat 10 that forms a fuel path and has a diameter reduced toward the downstream side and an upstream side plane 11*c* of the injection hole plate 11 intersect, and the exit part of the combined injection hole 32 is provided outside in the radial direction of the valve seat axis 34 relative to the entrance part.

As shown in FIGS. 10A to 10C, by forming the fuel flow from the upstream side of the combined injection hole 32, the mainstream of the fuel flow from the valve seat part 10*a* is further strengthened and the thin membrane of the fuel is formed within the combined injection hole 32, and the atomization is promoted.

Note that the invention is not limited to the examples shown in the embodiments, but various design changes may be made without departing the scope thereof.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A fuel injection valve comprising a valving element that opens and closes a valve seat, and, when opening the valve seat with the valving element, allowing fuel to pass through between the valving element and a valve seat surface and to be injected from plural holes provided in an injection hole plate attached at a downstream side of the valve seat, wherein the holes provided in the injection hole plate are combined injection holes formed by partially overlapping two or more single injection holes from an upstream side to a downstream side of the injection hole plate, each of the single injection holes is a circular hole having the same diameter in an entrance part at the upstream side and an exit part at the downstream side of the injection hole plate, at least one of the single injection holes has an injection hole angle α defined by a tilt angle of a center axis line connecting an entrance part center and an exit part center relative to a plate thickness direction of the injection hole plate, intersection angles β are provided so that, if center axis lines of the respective single injection holes forming the combined injection holes are projected on a plane orthogonal to a valve seat axis, the center axis lines of the respective single injection holes may intersect, and thereby, areas of exit parts are larger than areas of entrance parts in the combined injection holes, and the combined injection holes are formed by press working.

2. The fuel injection valve according to claim 1, wherein, in the combined injection hole, injection hole diameters of the plural single injection holes forming that hole are different.

3. The fuel injection valve according to claim 2, wherein the area of the entrance part in the combined injection hole is made equal to an area of an entrance part of the single injection hole having the maximum injection hole diameter of the single injection holes forming the combined injection hole.

4. The fuel injection valve according to claim 1, wherein the area of the entrance part in the combined injection hole is made equal to an area of an entrance part of the single injection hole having the maximum injection hole diameter of the single injection holes forming the combined injection hole.

5. The fuel injection valve according to claim 1, wherein, in the combined injection hole, all of injection hole diameters of the plural single injection holes forming that hole are the same.

6. The fuel injection valve according to claim 5, wherein, in the plural single injection holes, all of the injection hole angles α are equal.

7. The fuel injection valve according to claim 4, wherein, in the plural single injection holes, all of the injection hole angles α are equal.

8. The fuel injection valve according to claim 3, wherein, in the plural single injection holes, all of the injection hole angles α are equal.

9. The fuel injection valve according to claim 2, wherein, in the plural single injection holes, all of the injection hole angles α are equal.

10. The fuel injection valve according to claim 1, wherein, in the plural single injection holes, all of the injection hole angles α are equal.

11. The fuel injection valve according to claim 1, wherein, in the plural single injection holes, the injection hole angles α are different.

12. The fuel injection valve according to claim 1, wherein, in the combined injection hole, in the case where all of injection hole diameters D of the plural single injection holes forming that hole are the same, given that a distance between the centers of the exit parts of the adjacent single injection holes is ds, the adjacent single injection holes are formed by partially overlapping each other so that $0<ds\leq 3D/2$ may be satisfied.

13. A fuel injection valve comprising a valving element that opens and closes a valve seat, and, when opening the valve seat with the valving element, allowing fuel to pass through between the valving element and a valve seat surface and to be injected from plural holes provided in an injection hole plate attached at a downstream side of the valve seat, wherein the holes provided in the injection hole plate are combined injection holes formed by partially overlapping two or more single injection holes from an upstream side to a downstream side of the injection hole plate, each of the single injection holes is a circular hole having the same diameter in an entrance part at the upstream side and an exit part at the downstream side of the injection hole plate, at least one of the single injection holes has an injection hole angle α defined by a tilt angle of a center axis line connecting an entrance part center and an exit part center relative to a plate thickness direction of the injection hole plate, intersection angles β are provided so that, if center axis lines of the respective single injection holes forming the combined injection holes are projected on a plane orthogonal to a valve seat axis, the center axis lines of the respective single injection holes may intersect, and thereby, areas of exit parts are larger than areas of entrance parts in the combined injection holes, and the combined injection holes are formed by press working, wherein, in the combined injection hole, in the case where injection hole diameters of the plural single injection holes forming that hole are different between the adjacent single injection holes, given that the injection hole diameter of one having the larger injection diameter of the adjacent single injection holes is D and a distance between the centers of the exit parts of the adjacent single injection holes is ds, the adjacent single injection holes are formed by partially overlapping each other so that $0<ds\leq 3D/4$ may be satisfied.

14. The fuel injection valve according to claim 1, wherein the entrance part of the combined injection hole is provided inside a hypothetical envelope curve at which an extension of the valve seat surface of the valve seat that forms a fuel path and has a diameter reduced toward the downstream side and an upstream side plane of the injection hole plate intersect, and the exit part of the combined injection hole is provided outside in the radial direction of the valve seat axis relative to the entrance part.

* * * * *